US009892875B2

(12) United States Patent
Nomura et al.

(10) Patent No.: US 9,892,875 B2
(45) Date of Patent: Feb. 13, 2018

(54) GAS CIRCUIT BREAKER

(71) Applicant: Hitachi, Ltd., Chiyoda-ku, Tokyo (JP)

(72) Inventors: Daisuke Nomura, Tokyo (JP); Noriyuki Yaginuma, Tokyo (JP); Masanori Tsukushi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/309,601

(22) PCT Filed: Mar. 2, 2015

(86) PCT No.: PCT/JP2015/056029

§ 371 (c)(1),
(2) Date: Nov. 8, 2016

(87) PCT Pub. No.: WO2015/174122

PCT Pub. Date: Nov. 19, 2015

(65) Prior Publication Data

US 2017/0148591 A1 May 25, 2017

(30) Foreign Application Priority Data

May 16, 2014 (JP) ..... 2014-101903

(51) Int. Cl.
*H01H 33/88* (2006.01)

(52) U.S. Cl.
CPC ..... *H01H 33/88* (2013.01); *H01H 2033/888* (2013.01)

(58) Field of Classification Search
CPC ..... H01H 33/91; H01H 2033/908; H01H 33/7023; H01H 33/88; H01H 33/901;
(Continued)

(56) References Cited

U.S. PATENT DOCUMENTS 4,467,158 A * 8/1984 Kobayashi ..... H01H 1/385 218/57
5,151,566 A * 9/1992 Koyanagi ..... H01H 33/7023 218/62

(Continued)

FOREIGN PATENT DOCUMENTS

CN 1372287 A 10/2002
JP 2013-125720 A 6/2013

OTHER PUBLICATIONS

International Search Report (PCT/ISA/210) issued in PCT Application No. PCT/JP2015/056029 dated Apr. 21, 2015 with English translation (Two (2) pages).

(Continued)

*Primary Examiner* — Truc Nguyen
(74) *Attorney, Agent, or Firm* — Crowell & Moring LLP

(57) ABSTRACT

An insulation rod cover is fitted to an end portion of a puffer shaft and the insulation rod cover is fitted to a circuit-breaker side coupling pin coupling between a puffer shaft and an insulation rod, thereby allowing the insulation rod cover to be held at a joint between the puffer shaft and the insulation rod. In a first half of a circuit-breaking operation, the insulation rod cover is positioned in the exhaust cylinder and the exhaust of the hot gas from the puffer shaft is suppressed to increase the pressure of an extinguishing gas to be sprayed onto the arc. In a last half of the circuit-breaking operation, the insulation rod cover is positioned in a guard cylinder to promote the exhaust of the hot gas from the puffer shaft as well as to suppress the flow of the hot gas into the insulation cylinder.

8 Claims, 5 Drawing Sheets

(58) Field of Classification Search
CPC .. H01H 2033/888; H01H 33/22; H01H 33/42; H01H 33/7015; H01H 33/74; H01H 1/385; H01H 33/56; H01H 33/7076; H01H 33/905
See application file for complete search history.

(56) References Cited

U.S. PATENT DOCUMENTS

| | | | | |
|---|---|---|---|---|
| 5,977,502 | A * | 11/1999 | Mizoguchi | H01H 33/901 218/43 |
| 9,058,947 | B2 * | 6/2015 | Yaginuma | H01H 33/08 |
| 2002/0113040 | A1 * | 8/2002 | Imamura | H01H 33/91 218/43 |
| 2010/0147804 | A1 * | 6/2010 | Yamada | H01H 33/90 218/63 |
| 2015/0053647 | A1 * | 2/2015 | Yoshitomo | H01H 33/42 218/90 |
| 2015/0060411 | A1 * | 3/2015 | Yamashita | H01H 33/903 218/158 |

OTHER PUBLICATIONS

Japanese-language Written Opinion (PCT/ISA/237 issued in PCT Application No. PCT/JP2015/056029 dated Apr. 21, 2015 (Four (4) pages).
Chinese-language Office Action issued in counterpart Chinese Application No. 201580018816.X dated Jun. 7, 2017 (Ten (10) pages).

* cited by examiner

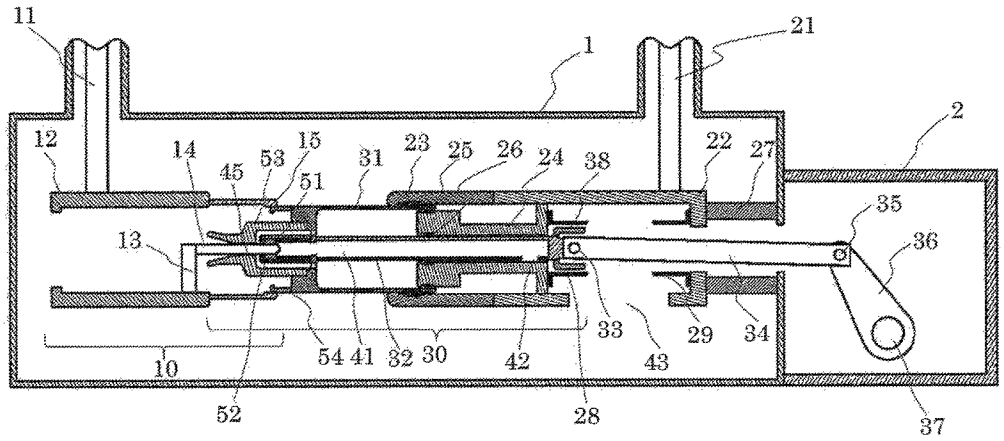
[FIG. 1]

[FIG. 2]
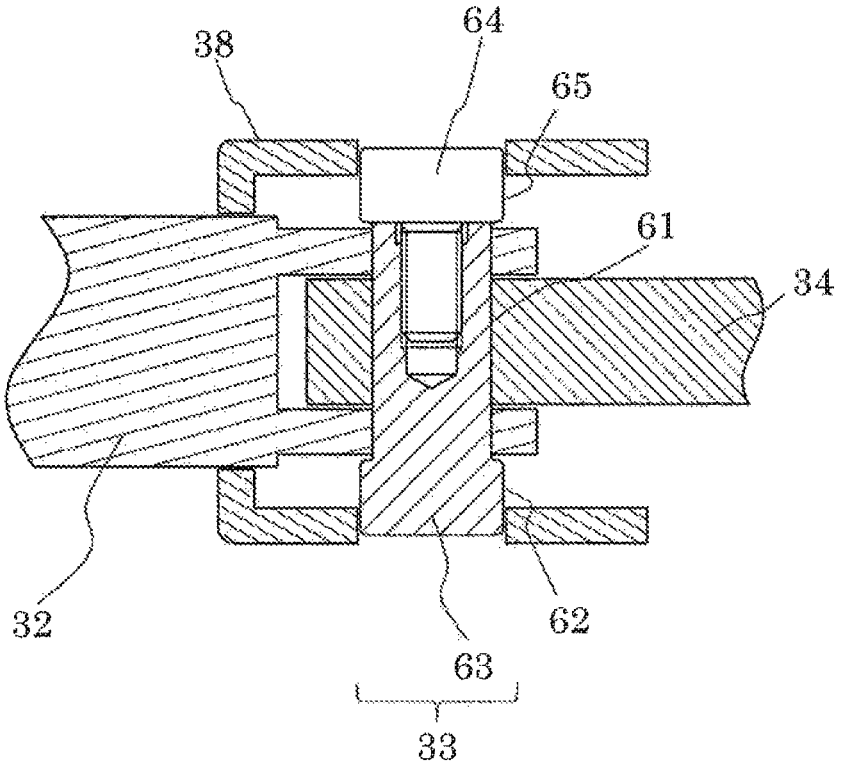

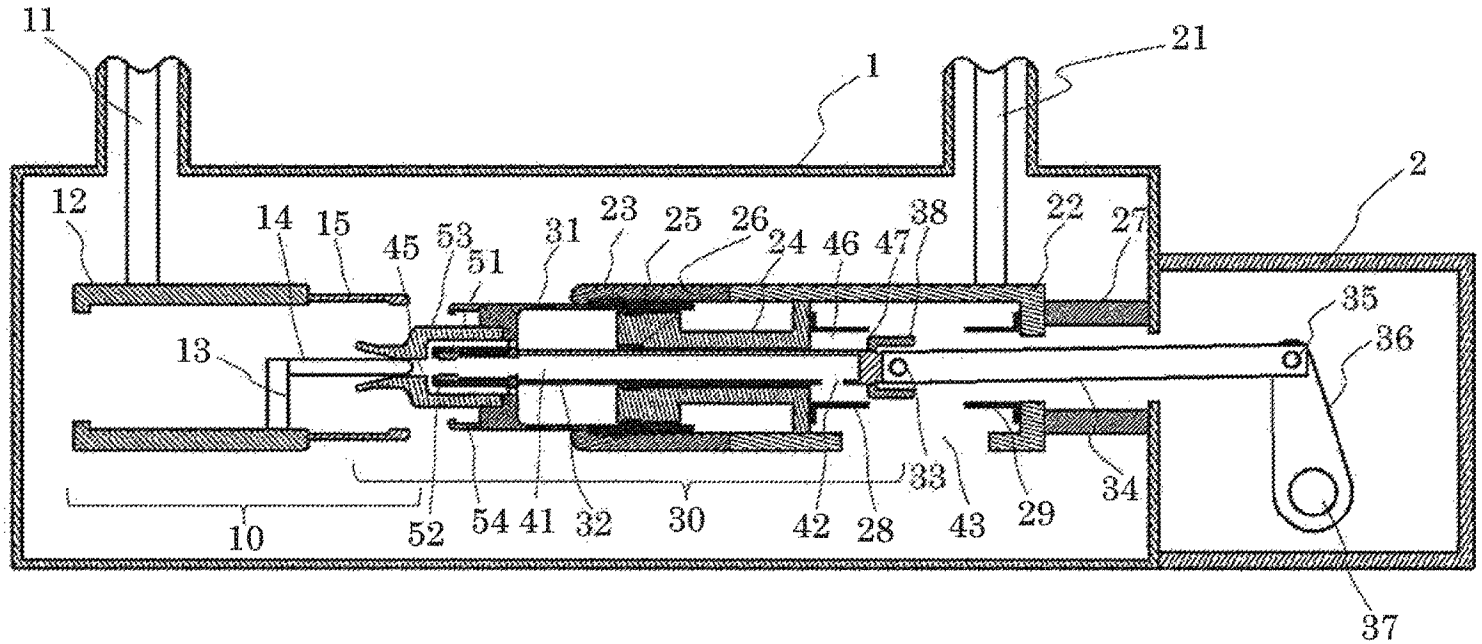
[FIG. 3]

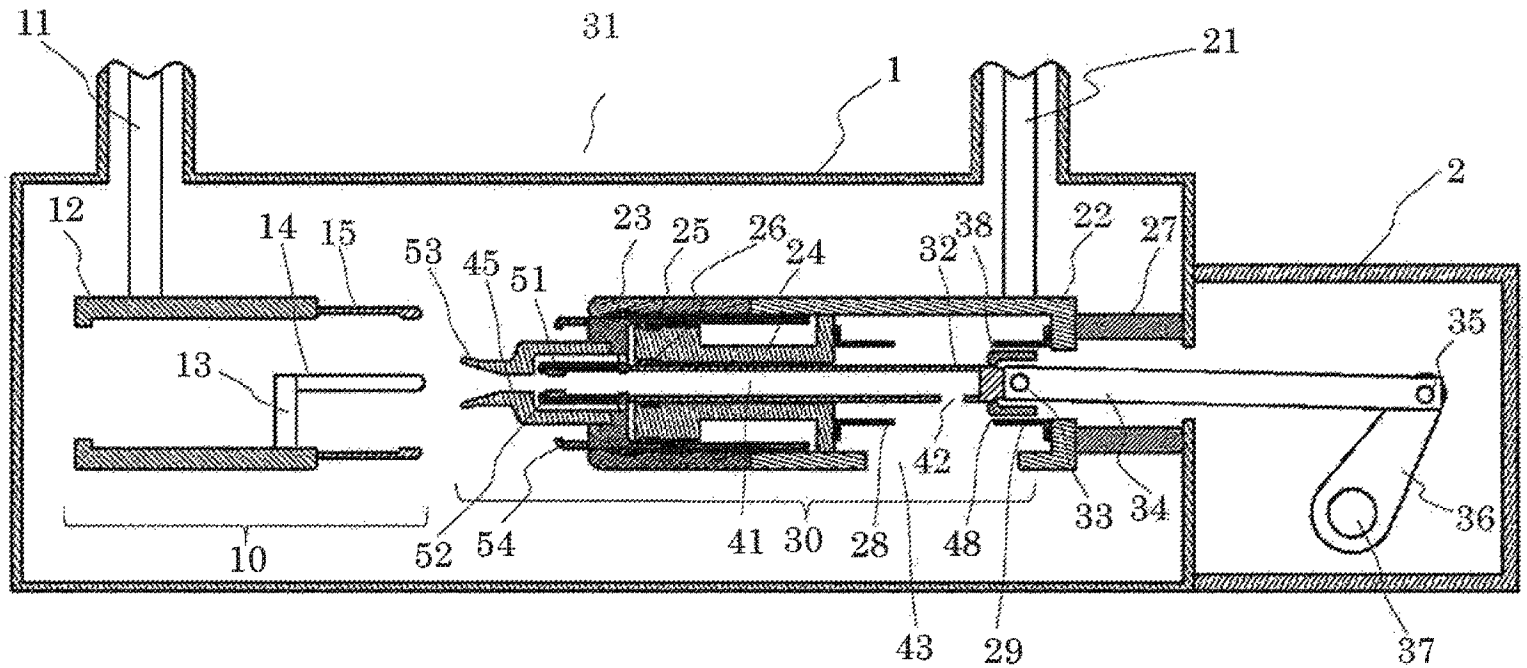
[FIG. 4]

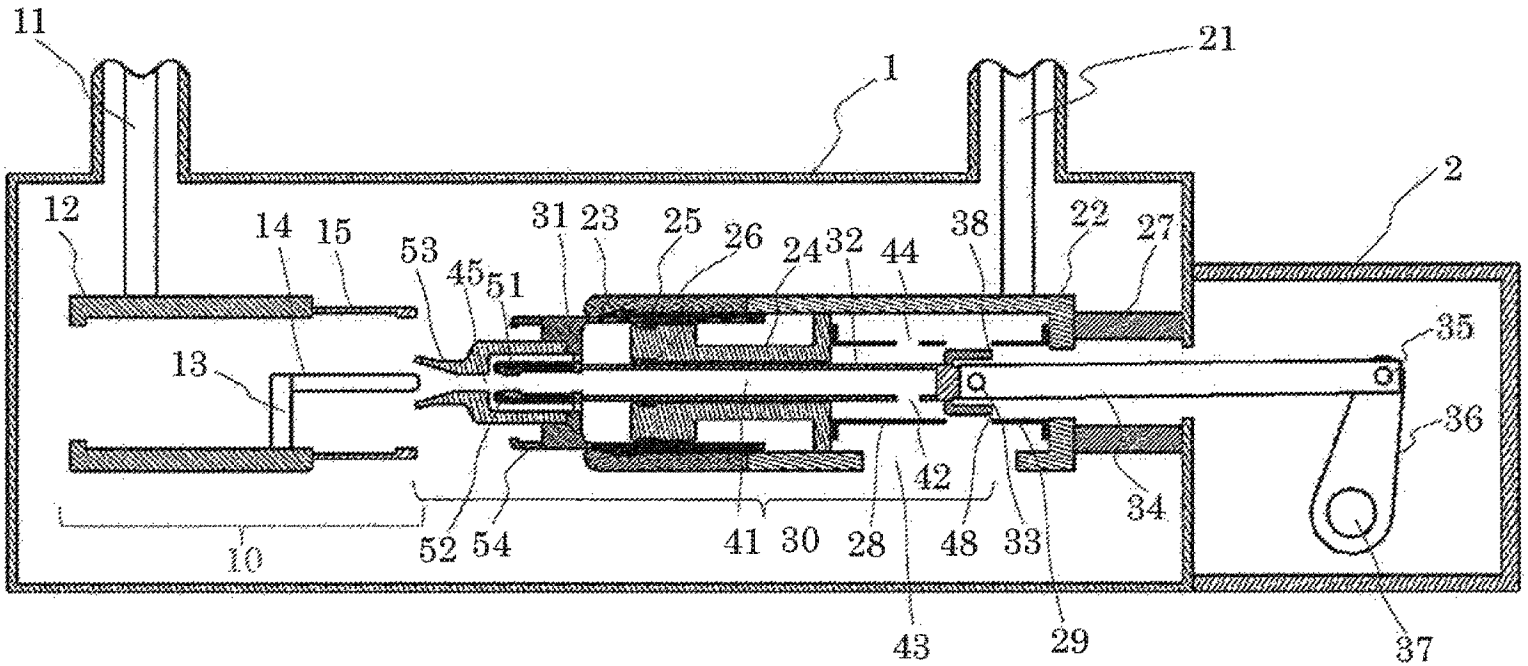
[FIG. 5]

GAS CIRCUIT BREAKER

TECHNICAL FIELD

The present invention relates to a gas circuit breaker for the power having an extinguishing gas, and particularly relates to an exhaust structure on a movable side of a circuit breaker part.

BACKGROUND ART

In recent years, the capacity of a circuit breaker is increased as voltage/current of a power system is increased, but a request for reducing cost and space by optimizing the structure of the circuit breaker part is increased, and it is required to secure excellent circuit-breaking performance with a lower operating force.

Gas circuit breakers including a thermal puffer type circuit breaker generally includes a puffer shaft connecting a movable-side circuit breaker part formed of a puffer cylinder, an insulating nozzle, a movable main contact and a movable arc contact to an insulating rod, and a gas passage is provided inside the puffer shaft.

The gas passage is provided for the purpose of spraying an extinguishing gas compressed in the puffer cylinder on the arc generated between the movable arc contact and a stationary arc contact, then, exhausting the gas to the movable side of the circuit breaker part.

The extinguishing gas passing through the gas passage of the puffer shaft is heated by the arc and contacts particles of a nozzle material and an electrode material melted by the arc, therefore, the gas has a high temperature and is contaminated. Due to the extinguishing gas with the high temperature (hereinafter referred to as a hot gas), the surface of the insulating rod or the inside of an insulation cylinder may be burned and carbonized, or conductive foreign substances may stick, which may drastically reduce the insulation performance and may cause a ground fault.

In Patent Literature 1, there is disclosed a gas circuit breaker including a puffer shaft coupled to an insulation rod side through a shaft guide and an exhaust cylinder provided inside a movable-side main circuit conductor so as to surround the insulation rod, in which a piston ring provided in an outer periphery of the shaft guide slides inside the exhaust cylinder. The invention contributes to the improvement in insulation performance of the gas circuit breaker by blocking a flow path through which the hot gas flows toward the insulation rod and the insulation cylinder.

CITATION LIST

Patent Literature

Patent Literature 1: JP-A 2013-125720

SUMMARY OF INVENTION

Technical Problem

As a gap between the exhaust cylinder and the shaft guide is completely blocked with the piston ring in the gas circuit breaker disclosed in Patent Literature 1, the piston ring slides while directly contacting an inner surface of the exhaust cylinder, therefore, slight sliding resistance is generated. Moreover, as the shaft guide has an outer diameter which is approximately equal to an inner diameter of the exhaust cylinder, a certain degree of size and rigidity may be necessary. An object of the present invention is to provide a gas circuit breaker capable of protecting the insulation rod and the insulation cylinder from the hot gas, improving the insulation performance and realizing smooth breaking operation with a lighter and simpler structure.

Solution to Problem

According to an embodiment of the present invention, there is provided a gas circuit breaker having an insulation tank filled with an extinguishing gas, a pair of a stationary-side main circuit conductor and a movable-side main circuit conductor provided in insulation tank, a stationary-side contact and a movable-side contact provided between the stationary-side main circuit conductor and the movable-side main circuit conductor so as to be separated, a puffer cylinder having the movable-side contact at one end, a puffer chamber formed in the puffer cylinder, an insulation nozzle forming a flow path for leading the extinguishing gas in the puffer chamber to arc generated between the movable-side contact and the stationary-side contact, a puffer shaft having a gas passage for leading the extinguishing gas led to the arc to the movable side of a circuit breaker part and exhausting the gas, and an insulation rod coupled to the puffer shaft, which includes a hot gas blocking member at a joint between the puffer shaft and the insulation rod.

Advantageous Effects of Invention

According to the present invention, the improvement in insulation performance and circuit-breaking performance of the gas circuit breaker can be realized with a simple structure

BRIEF DESCRIPTION OF DRAWINGS

FIG. 1 is a cross-sectional view of an input state of a gas circuit breaker to which a movable-side exhaust structure according to Example 1 is applied.

FIG. 2 is an enlarge view of an insulation rod cover portion according to Example 1.

FIG. 3 is a cross-sectional view of a circuit-breaking process (intermediate position) of the gas circuit breaker to which the movable-side exhaust structure according to Example 1 is applied.

FIG. 4 is a cross-sectional view of a circuit-breaking process (circuit-breaking position) to which the movable-side exhaust structure according to Example 1 is applied.

FIG. 5 is a cross-sectional view of a gas circuit breaker to which a movable-side exhaust structure according to Example 2 is applied.

DESCRIPTION OF EMBODIMENTS

Hereinafter, embodiments of the present invention will be explained with reference to the drawings. The following are lust examples and do not intend to limit the contents of the invention to the following specific examples. The invention itself may be achieved in various manners in conformity with the contents described in claims.

Example 1

FIG. 1 is a schematic view of an inside of a gas circuit breaker formed by using an exhaust structure according to the present invention. Structures other than the exhaust structure are the same as structures of a related-art puffer-type gas circuit breaker.

An extinguishing gas such as an $SF_6$ gas is sealed in an insulation tank 1, and a stationary-side live conductor 11 and a movable-side live conductor 21 are drawn into the tank.

The stationary-side live conductor 11 is electrically connected to a stationary-side main circuit conductor 12, a stationary arc contact base 13, a stationary arc contact 14 and a stationary main contact 15 which configure a stationary-side circuit breaker part 10.

The movable-side live conductor 21 is electrically connected to a circuit-breaker part movable portion 30 through a movable-side main circuit conductor 22, a sliding contact 23 and a puffer cylinder 31.

A stationary piston is disposed inside the movable-side main circuit conductor 22, and an inner cylinder surface of the puffer cylinder 31 is supported by a puffer cylinder supporting sliding guide 25 attached to an outer periphery of the stationary piston 24. The sliding contact 23 is provided in an inner periphery of the movable-side main circuit conductor 22, which contact an outer cylinder surface of the puffer cylinder 31. According to the structure, the puffer cylinder 31 can move in an axial direction while maintaining electrical connection through the movable-side main circuit conductor 22 and the sliding contact 23.

A through hole is provided in the center of the stationary piston 24, and a puffer shaft 32 having a gas passage 41 thereinside is disposed inside the stationary piston 24 so as to slide freely. The puffer shaft 32 is supported by a puffer-shaft supporting sliding guide 26 attached in an inner periphery of the stationary piston 24.

One end of the puffer shaft 32 is fixed to the puffer cylinder 31 and the other end of the puffer shaft 32 is coupled to one end of an insulation rod 34 through a circuit-breaker side coupling pin 33. The other side of the insulation rod 34 is coupled to a lever 36 housed in a mechanism case 2 provided adjacent to the insulation tank 1 through a lever-side coupling pin 35.

A shaft 37 of the lever 36 is supported by the mechanism case 2 so as to rotate freely. The lever 36 is connected to an actuator (not shown) on the outside of the mechanism case 2 through the shaft 37. The lever 36 rotates by a drive force of the actuator, and the circuit breaker part movable portion 30 moves in the axial direction.

A movable arc contact 51 is provided in the center of a tip portion of the puffer cylinder 31. An insulation cover 52, an insulation nozzle 53 and a movable main contact 54 are respectively arranged in a concentric manner so as to surround an outer periphery of the movable arc contact 51.

The movable arc contact. 51 has a through hole, which is connected to the gas passage 41 inside the puffer shaft 32 through the puffer cylinder 31. The gas passage 41 of the puffer shaft 32 extends to the vicinity of a joint between the puffer shaft 32 and the insulation rod 34, opening at an opening A 42 on a cylinder surface of the puffer shaft 32 in a radial direction.

The movable-side main circuit conductor 22 is supported by an insulation cylinder 27 fixed to the insulation tank 1. The movable-side main circuit conductor 22 has an opening B 43 on a side surface, which communicates into the insulation tank 1. The movable-side main circuit conductor 22 has a guard cylinder 29 thereinside close to the insulating cylinder 27 and an exhaust cylinder 28 close to the stationary piston 24. The guard cylinder 29 and the exhaust cylinder 28 are fixed to an inner wall of the movable-side main circuit conductor 22 and the stationary piston 24 by means of, for example, bolt fastening.

The insulation rod 34 is disposed inside the exhaust cylinder 28, the guard cylinder 29 and the insulation cylinder 27 so as to move freely in the axial direction. The joint between the puffer shaft 32 and the insulation rod 34 housed inside the exhaust cylinder 28 is covered with an insulation rod cover 38.

FIG. 2 shows a structure of the joint between the puffer shaft 32 and the insulation rod 34.

A pin portion 61 of the circuit-breaker side coupling pin 33 penetrates through a pin hole of the puffer shaft 32 and a pin hole of the insulation rod 34, and the puffer shaft 32 and the insulation rod 34 are coupled so as to rotate freely around an axis of the circuit-breaker side coupling pin 33.

The circuit-breaker side coupling pin 33 is formed of a female screw component 63 and a male screw component 64. The female screw component 63 includes an insulation rod cover support portion A 62 and the pin portion 61 having a female screw portion. The male screw component 64 includes an insulation rod cover support portion B 65 and a male screw portion. The circuit-breaker side coupling pin 33 has a structure in which the female screw component 63 is combined with the males screw component 64 by screwing and so on, which can be assembled and disassembled from both sides of the pin hole. In the description, the combined structure is referred to as a divided structure.

The insulation rod cover 38 is a cylindrical member having a size to be housed inside the exhaust cylinder 28 and the guard cylinder 29, which is made of PTFE (polytetrafluoroethylene). Materials other than PTFE may be used as long as materials have excellent heat durability and mechanical strength and are light in weight.

An end portion of the puffer shaft 32 is fitted to the insulating rod cover 38. On an outer cylinder surface of insulating rod cover 38, there is formed a through hole a diameter of which is slightly larger than the insulation rod cover support portion A 62 and the insulation rod cover support portion B 65 of the circuit-breaker side coupling pin 33. As the insulation rod cover support portion A 62 and the insulation rod cover support portion B 65 of the circuit-breaker side coupling pin 33 are fitted to the through hole, the insulating rod cover 38 is held by the circuit-breaker side coupling pin 33. That is, the insulating rod cover 38 is held by the end portion of the puffer shaft 32 and the circuit-breaker side coupling pin 33 so as to cover the joint between the puffer shaft 32 and the insulation rod 34.

As the structure of covering the joint is adopted as described above, it is possible to prevent foreign substances carried by a hot gas from sticking to the joint between the puffer shaft 32 and the insulation rod 34, therefore, a later-described vertical motion of the insulation rod 34 can be maintained to be smooth.

Moreover, as the structure of holding the insulation rod cover is adopted as described above, it is possible to prevent the insulation rod cover from falling off due to an impact of a circuit-breaking operation. Therefore, the reliability of the circuit breaker can be improved.

The structure of the insulation rod cover 38 is an example of the member for blocking the hot gas. The structure in which foreign substances carried by the hot gas can be prevented from sticking to the joint between the puffer shaft 32 and the insulation rod 34 as well as the insulation rod cover can be prevented from falling off can be applied to the circuit breaker according to the present invention, not being limited to the above insulation rod cover 38.

The insulation rod cover 38 moves along inner surfaces of the exhaust cylinder 28 and the guard cylinder 29 with the circuit-breaker side coupling pin 33 when the circuit breaker part movable portion 30 moves. When the drive force of the actuator (not shown) is transmitted to the lever 36 through the shaft 37 and the lever 36 moves in an arc, the insulation rod 34 vertically moves slightly with the circuit-breaker side coupling pin 33 as a fulcrum. An inner diameter of the opening of the insulation rod cover 38 on the side not fitted to the puffer shaft 32 is formed to be a size not interfering with the exhaust cylinder 28 and the guard cylinder 29 even when the insulation rod 34 vertically moves.

It is preferable to form the fitted portion between the insulation rod cover 38 and the puffer shaft 32 with a gap as small as possible for preventing the infiltration of the hot gas from the circuit breaker part.

The structure of the embodiment will be explained based on the circuit-breaking operation. FIG. 1 shows an input state of the gas circuit breaker, in which the movable main contact 54 is inserted into the stationary main contact 15, and the circuit breaker part movable portion 30 and the stationary-side circuit breaker part 10 are electrically connected completely.

In this state, the inside of a throat portion 45 as the minimum diameter portion of the insulation nozzle 53 and the movable arc contact 51 is almost blocked by the stationary arc contact 14, and the opening A 42 of the puffer shaft 32 is closed as it is positioned inside the stationary piston 24. The insulation rod cover 38 is also housed inside the exhaust cylinder 28.

When the circuit breaker part movable portion 30 moves to the movable side by the circuit-breaking operation from the state shown in FIG. 1, the movable arc contact 51 is separated from the stationary arc contact 14. In the case where a large electric current flows between the circuit breaker part movable portion 30 and the stationary-side circuit breaker part 10 in the above state, the electric current is not interrupted even when the movable arc contact 51 is separated from the stationary arc contact 14, and the arc is generated between the movable arc contact 51 and the stationary arc contact 14, therefore, the electric current continues flowing.

When the circuit-breaking operation proceeds after the movable arc contact 51 and the stationary arc contact 14 are separated to be a state shown in FIG. 3, the throat portion 45 is almost blocked by the stationary arc contact 14, but the end portion of the circuit breaker part movable portion 30 on the actuator's side is opened as the opening A 42 moves to a space D 46 formed between the exhaust cylinder 28 and the insulation rod cover 38. Accordingly, the flow of the hot gas exhausted to the movable-side main circuit conductor 22 through the gas passage 41 inside the puffer shaft 32 is formed.

In the structure of the embodiment, the hot gas exhausted from the opening A 42 of the puffer shaft 32 is first released to the space D 46 formed by the exhaust cylinder 28 and the insulation rod cover 38. The hot gas exhausted from the opening A 42 has a high temperature and contains particles of a nozzle material or an electrode material melted by the arc.

The insulation rod 34 is generally formed of a GFRP (glass fiber reinforced plastic) coated with an extinguishing-gas resistance film. When the hot gas is directly sprayed on the insulation rod 34, the coating on the surface may be burned and the insulation performance may be reduced. Moreover, when particles of the electrode material and so on contained in the hot gas are fused into a slight gap existing between the circuit-breaker side coupling pin 33 and the insulation rod 34 as well as between the lever-side coupling pin 35 and the insulation rod 34, the smooth circuit-breaking operation may be inhibited.

The gas circuit breaker according to the embodiment can prevent the reduction of the insulation performance in the insulation rod 34 as it is possible to prevent the hot gas from being directly sprayed onto the insulation rod 34 due to the insulation rod cover 38. It is also possible to prevent the above-described particles from sticking to the joint portion between the insulation rod 34 and the puffer shaft 32, therefore, the smooth circuit-breaking operation can be realized.

On the other hand, the structure of the present invention including the exhaust cylinder 28, the insulation rod cover 38 and the guard cylinder 29 also contributes to the improvement in circuit-breaking performance as described below.

As shown in FIG. 3, the hot gas released to the space 46 passes through a gap E 47 between the exhaust cylinder 28 and the insulation rod cover 38 and flows to the downstream side of the circuit breaker part, namely, to the outside of the exhaust cylinder 28. When the cross-sectional area of the gap F 47 is sufficiently small with respect to the cross-sectional area of the space D 46, there are advantages that the exhaust of the hot gas from the gas passage 41 is suppressed and the pressure inside the puffer cylinder 31 is increased. The increase of the pressure inside the puffer cylinder 31 at the time of staring the circuit-breaking operation leads to the improvement in circuit-breaking performance.

As the circuit-breaking operation further proceeds and the stationary arc contact 14 comes off from the throat portion 45, or the gap E 47 becomes sufficiently large as shown in FIG. 4, the hot gas passes through the throat portion 45 and flows to the stationary arc contact 14, therefore, two flow paths of the hot gas divided into the stationary side and the movable side are formed.

In the state shown in FIG. 4, the gas released from the opening A 42 is released into the movable-side main circuit conductor 22 and is exhausted from the opening B 43 of the movable-side main circuit conductor 22. The flow of the extinguishing gas which is not suppressed is formed as an exit of the space D 46 is not blocked by the insulation rod cover 38, therefore, the hot gas generated by arc is smoothly exhausted and the cooling of the movable arc contact 51 is also promoted.

In the structure of the embodiment, the insulation rod cover 38 moves to the inside of the guard cylinder 29 in a last half of the circuit-breaking operation. As the area of a gap F 48 between the guard cylinder 29 and the insulation rod cover 38 is sufficiently smaller than the area of the opening B 43, she flow path resistance is high and the flowing of the hot gas into the insulation cylinder 27 can be suppressed. Accordingly, it is possible to prevent the insulation rod 34 and the insulation cylinder 27 from being contaminated by the hot gas, therefore, the reduction in the insulation performance can be prevented.

In the description, while the stationary arc contact 14 moves in the throat portion 45 of the insulation nozzle 53 from the start of the circuit-breaking operation (namely, a period of the circuit-breaking operation in which the pressure of the extinguishing gas inside the puffer cylinder 31 is increased) is defined as a first half of a circuit-breaking operation. A period in which the circuit-breaking operation is completed after the stationary arc contact 14 comes off from the throat portion 45 of the insulation nozzle 53 is defined as a last half of a circuit-breaking operation.

Example 2

Another embodiment of the present invention will be explained with reference to FIG. 5. The same numerals are given to the same components as those of Example 1 and the explanation is omitted.

In Example 2, the exhaust cylinder 28 is extended so that a length of a gap between the exhaust cylinder 28 and the guard cylinder 29 is approximately equal to a length of the insulation rod cover 38 in the axial direction, and an exhaust hole C 44 is provided on a side surface of the exhaust cylinder 28.

In the structure in which the exhaust cylinder 28 is extended as shown in FIG. 5, the insulation rod cover 38 enters the inside of the guard cylinder 29 just after the insulating rod cover 38 comes off from the exhaust cylinder 28, therefore, the flow of the hot gas toward the insulation cylinder 27 can be blocked. Accordingly, the reduction in the insulation performance of the insulation cylinder 27 and the insulation rod 34 can be prevented.

When the exhaust cylinder 28 is simply extended, the hot gas accumulated in the space D 46 inside the exhaust cylinder 28 is not released and there is a risk that the temperature inside the exhaust cylinder 28 is drastically increased and the circuit-breaking performance is reduced. In response to this, the exhaust hole C 44 is provided on the side surface of the exhaust cylinder 28 and the hot gas accumulated in the space D 46 inside the exhaust cylinder 28 is released from the exhaust hole C 44 on the side surface during the circuit breaking operation, thereby preventing the reduction of the circuit-breaking performance.

The above explanation has been made by citing the machine-puffer type as circuit breaker as an example, however, the present invention can be naturally applied to dual-chamber puffer type gas circuit breaker, and the above advantages can be obtained also when the present invention is applied to the dual-chamber puffer type gas circuit breaker.

REFERENCE SIGNS LIST

1 insulation tank
2 mechanism case
10 stationary-side circuit breaker part
11 stationary-side live conductor
12 stationary-side main circuit conductor
13 stationary arc contact base
14 stationary arc contact
15 stationary main contact
21 movable-side live conductor
22 movable-side main circuit conductor
23 sliding contact
24 stationary piston
25 puffer cylinder supporting sliding guide
26 puffer-shaft supporting sliding guide
27 insulation cylinder
28 exhaust cylinder
29 guard cylinder
30 circuit breaker part movable portion
31 puffer cylinder
32 puffer shaft
33 circuit-breaker side coupling pin.
34 insulation rod
35 lever-side coupling pin
36 lever
37 shaft
38 insulation rod cover
41 gas passage
42 opening A
43 opening B
44 exhaust hole C
45 throat portion
46 space D
47 gap 3
48 gap F
51 movable arc contact
52 insulation cover
53 insulation nozzle
54 movable main contact
61 pin portion
62 insulation rod cover support portion A
63 female screw component
64 male screw component
65 insulation rod cover support portion B

The invention claimed is:

1. A gas circuit breaker including
an insulation tank filled with an extinguishing gas,
a pair of a stationary-side main circuit conductor and a movable-side main circuit conductor provided in the insulation tank,
a stationary-side contact and a movable-side contact provided between the stationary-side main circuit conductor and the movable-side main circuit conductor so as to be separated,
a puffer cylinder having the movable-side contact at one end,
a puffer chamber formed in the puffer cylinder,
an insulation nozzle forming a flow path for leading the extinguishing gas in the puffer chamber to arc generated between the movable-side contact and the stationary-side contact,
a puffer shaft having a gas passage for leading the extinguishing gas led to the arc to the movable side of a circuit breaker part and exhausting the gas, and
an insulation rod coupled to the puffer shaft, the breaker comprising:
a hot gas blocking member at a joint between the puffer shaft and the insulation rod,
wherein the movable-side main circuit conductor is held by an insulation support member inside the insulation tank,
a stationary piston sliding on an inner peripheral surface of the puffer cylinder is provided in an inner periphery of the movable-side main circuit conductor,
the stationary piston has an exhaust cylinder,
a guard cylinder is provided at an end portion of the movable-side main circuit conductor on a side apart from the circuit breaker part,
the puffer shaft moves freely inside the exhaust cylinder and the guard cylinder in accordance with a circuit-breaking operation,
the hot gas blocking member is positioned inside the exhaust cylinder to block the exhaust cylinder in a first half of a circuit-breaking operation, and
the hot gas blocking member moves to the outside of the exhaust cylinder and releases the exhaust cylinder to thereby lead the extinguishing gas led to the arc to the movable side of the circuit breaker part and exhaust the gas in a second half of the circuit-breaking operation.

2. The gas circuit breaker according to claim 1,
wherein the hot gas blocking member is held at the joint between the puffer shaft and the insulation rod with an end portion of the puffer shaft being fitted and with both end portions of a pin coupling the puffer shaft to the insulation rod being fitted.

3. The gas circuit breaker according to claim 2,
wherein the pin has a divided structure.

4. The gas circuit breaker according to claim 1, wherein a length of a gap between the exhaust cylinder and the guard cylinder is approximately equal to a length of the hot gas blocking member in an axial direction.

5. A gas circuit breaker including an insulation tank filled with an extinguishing gas, a pair of a stationary-side main circuit conductor and a movable-side main circuit conductor provided in the insulation tank, a stationary-side contact and a movable-side contact provided between the stationary-side main circuit conductor and the movable-side main circuit conductor so as to be separated, a puffer cylinder having the movable-side contact at one end, a puffer chamber formed in the puffer cylinder, an insulation nozzle forming a flow path for leading the extinguishing gas in the puffer chamber to arc generated between the movable-side contact and the stationary-side contact, a puffer shaft having a gas passage for leading the extinguishing gas led to the arc to the movable side of a circuit breaker part and exhausting the gas, and an insulation rod coupled to the puffer shaft, the breaker comprising:

a hot gas blocking member at a joint between the puffer shaft and the insulation rod, wherein the movable-side main circuit conductor is held by an insulation support member inside the insulation tank, a stationary piston sliding on an inner peripheral surface of the puffer cylinder is provided in an inner periphery of the movable-side main circuit conductor, the stationary piston has an exhaust cylinder, a guard cylinder is provided at an end portion of the movable-side main circuit conductor on a side apart from the circuit breaker part, the puffer shaft moves freely inside the exhaust cylinder and the guard cylinder in accordance with a circuit-breaking operation, the hot gas blocking member is positioned inside the exhaust cylinder to block the exhaust cylinder in a first half of a circuit-breaking operation, and the hot gas blocking member is positioned inside the guard cylinder to thereby block the guard cylinder in a second half of the circuit-breaking operation.

6. The gas circuit breaker according to claim 5, wherein the hot gas blocking member is held at the joint between the puffer shaft and the insulation rod with an end portion of the puffer shaft being fitted and with both end portions of a pin coupling the puffer shaft to the insulation rod being fitted.

7. The gas circuit breaker according to claim 6, wherein the pin has a divided structure.

8. The gas circuit breaker according to claim 5, wherein a length of a gap between the exhaust cylinder and the guard cylinder is approximately equal to a length of the hot gas blocking member in an axial direction.

* * * * *